US010806184B2

(12) United States Patent
Hu et al.

(10) Patent No.: US 10,806,184 B2
(45) Date of Patent: Oct. 20, 2020

(54) ELECTRONIC CIGARETTE AND ATOMIZER THEREOF

(71) Applicant: Shenzhen First Union Technology Co., Ltd., Shenzhen, Guangdong Province (CN)

(72) Inventors: Peng Hu, Guangdong Province (CN); Yuanhua Feng, Guangdong Province (CN); Zhongli Xu, Guangdong Province (CN); Yonghai Li, Guangdong Province (CN)

(73) Assignee: Shenzhen First Union Technology Co., Ltd., Shenzhen, Guangdong (CN)

( * ) Notice: Subject to any disclaimer, the term of this patent is extended or adjusted under 35 U.S.C. 154(b) by 343 days.

(21) Appl. No.: 15/990,528

(22) Filed: May 25, 2018

(65) Prior Publication Data

US 2018/0338536 A1 Nov. 29, 2018

(30) Foreign Application Priority Data

May 27, 2017 (CN) ..... 2017 1 0391166

(51) Int. Cl.
*A24F 47/00* (2020.01)
*H05B 3/44* (2006.01)

(52) U.S. Cl.
CPC ..... *A24F 47/008* (2013.01); *A24F 47/00* (2013.01); *H05B 3/44* (2013.01); *H05B 2203/021* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 2017/0127722 | A1 | 5/2017 | Davis et al. | |
| 2018/0249761 | A1* | 9/2018 | Servutas | A24F 47/008 |
| 2018/0317286 | A1* | 11/2018 | Rojo-Calderon | H05B 6/106 |
| 2018/0338536 | A1* | 11/2018 | Hu | A24F 47/00 |
| 2019/0150512 | A1* | 5/2019 | Furudono | A24F 47/008 |

FOREIGN PATENT DOCUMENTS

| | | | |
|---|---|---|---|
| CN | 103 689 812 | A | 4/2014 |
| EP | 2 444 112 | A1 | 4/2012 |
| WO | 2016/169119 | A1 | 10/2016 |

* cited by examiner

*Primary Examiner* — James Harvey
(74) *Attorney, Agent, or Firm* — Proi Intellectual Property US; Klaus Michael Schmid

(57) ABSTRACT

An atomizer disclosed including: a sleeve; a liquid storage sleeve disposed at an end of the sleeve along an axial direction of the sleeve; and an atomizing assembly, the atomizing assembly comprises a liquid conducting body and a heating element; the liquid conducting body is disposed in the sleeve along an axial direction of the sleeve, extending from the sleeve into the liquid storage sleeve; the heating element is sleeved on outside of the liquid conducting body and configured for heating the tobacco liquid absorbed by the liquid conducting body, to generate an aerosol in an atomizing space between the sleeve and the heating element.

18 Claims, 3 Drawing Sheets

ELECTRONIC CIGARETTE AND ATOMIZER THEREOF

TECHNICAL FIELD

The present disclosure relates to the field of electronic cigarettes, and in particular, to an electronic cigarette and an atomizer thereof.

BACKGROUND ART

As a substitute of traditional cigarettes, electronic cigarettes are also named virtual cigarettes that are receiving more and more concerns and becoming more and more popular for they have advantages such as safety, no second-hand smoke, no open flames and no fire hazards in use.

In a typical electronic cigarette, the electronic cigarette generally adopts a liquid conducting body for absorbing tobacco liquid from a liquid storage sleeve. The liquid conducting body provided inside is a heating element for heating the absorbed tobacco liquid to generate an aerosol that flows into a mouth piece communicated with the liquid conducting body to be sucked by a user, of which inside space of the liquid conducting body is comparatively small so as to generate an incomplete atomized tobacco liquid membrane, when the user is smoking, the tobacco liquid membrane would produce a fried phenomenon, making the user suck incomplete atomized tobacco liquid, therefore, lowering user experience and safety.

SUMMARY

In view of the drawbacks in the electronic cigarettes known to the inventors, to solve a problem in a process that a heating element disposed in a liquid conducting body is heating tobacco liquid, incomplete atomized tobacco liquid membrane is generated to lower user experience and safety, the present disclosure generally relates to an electronic cigarette and an atomizer thereof.

To overcome the above shortages, the present disclosure relates to the atomizer including:

a sleeve;

a liquid storage sleeve disposed at an end of the sleeve along an axial direction of the sleeve; and an atomizing assembly, including a liquid conducting body and a heating element; the liquid conducting body is disposed in the sleeve along an axial direction of the sleeve, extending from the sleeve into the liquid storage sleeve; the heating element is sleeved on outside of the liquid conducting body and configured for heating the tobacco liquid absorbed by the liquid conducting body from the liquid storage sleeve, to generate an aerosol in an atomizing space between the sleeve and the heating element.

Further, the liquid conducting body is a barrel-shaped structure, provided inside with an liquid filling tube; the liquid filling tube extends from the sleeve into the liquid storage sleeve and is configured for conveying the tobacco liquid that is injected into the liquid filling tube through an distal end of the sleeve away from the liquid storage sleeve, to the liquid storage sleeve.

Further, an distal end of the liquid filling tube away from the liquid storage sleeve has a cover component, the cover component is detachably connected with the liquid filling tube; when injecting the tobacco liquid into the liquid filling tube, the cover component is detached from the liquid filling tube; and the cover component blocks the liquid filling tube after injecting tobacco liquid.

Further, the liquid filling tube includes a first liquid filling tube and a second liquid filling tube detachably connected with each other, the first liquid filling tube is inserted with the cover component, the second liquid filling tube is partly disposed in the liquid storage sleeve, a side wall of the second liquid filling tube has an liquid inlet communicated with the liquid storage sleeve.

Further, the atomizer includes a mouth piece disposed at the other end of the sleeve along an axial direction of the sleeve; the mouth piece has an aerosol outlet pipe, the aerosol in the atomizing space flows into the aerosol outlet pipe through an L-shaped passage.

Further, a radial size of the aerosol outlet pipe is less than that of the liquid conducting body.

Further, the sleeve includes an inner sleeve and an outer sleeve inserted into each other; side walls of the inner sleeve and the outer sleeve respectively have a first air inlet and a second air inlet, the first air inlet is closer to the liquid storage sleeve compared to the second air inlet along an axial of the sleeve.

Further, the atomizer includes a separator sleeved on outside of the liquid conducting body to avoid the tobacco liquid in the liquid storage sleeve flowing from outside of the liquid conducting body into the atomizing space.

Further, the separator is an elastic ring, outside edge of the elastic ring is fixed by the sleeve and the liquid storage sleeve, the inside edge of the elastic ring abuts against the liquid conducting body.

In order to solve the above problems, the present disclosure further relates to an electronic cigarette including the aforementioned atomizer.

Compared to the prior art known to the inventors, the present disclosure utilizes a liquid storage sleeve formed at an end of the sleeve along an axial direction of the sleeve, the liquid conducting body is disposed in the sleeve along an axial direction of the sleeve, extending from the sleeve into the liquid storage sleeve; the heating element is sleeved on outside of the liquid conducting body and configured for heating the tobacco liquid absorbed by the liquid conducting body, to generate an aerosol in an atomizing space between the sleeve and the heating element. Compared to the prior art of the heating element arranged inside the liquid conducting body to generate an aerosol, the atomizing space is bigger, since contact surface between the heating element and the liquid conducting body, the atomizing effect of the heating element with the tobacco liquid in the liquid conducting body is more deep, therefore, it is difficult for the heating element to generate incomplete tobacco liquid membrane, thus the user experience and safety have been improved.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
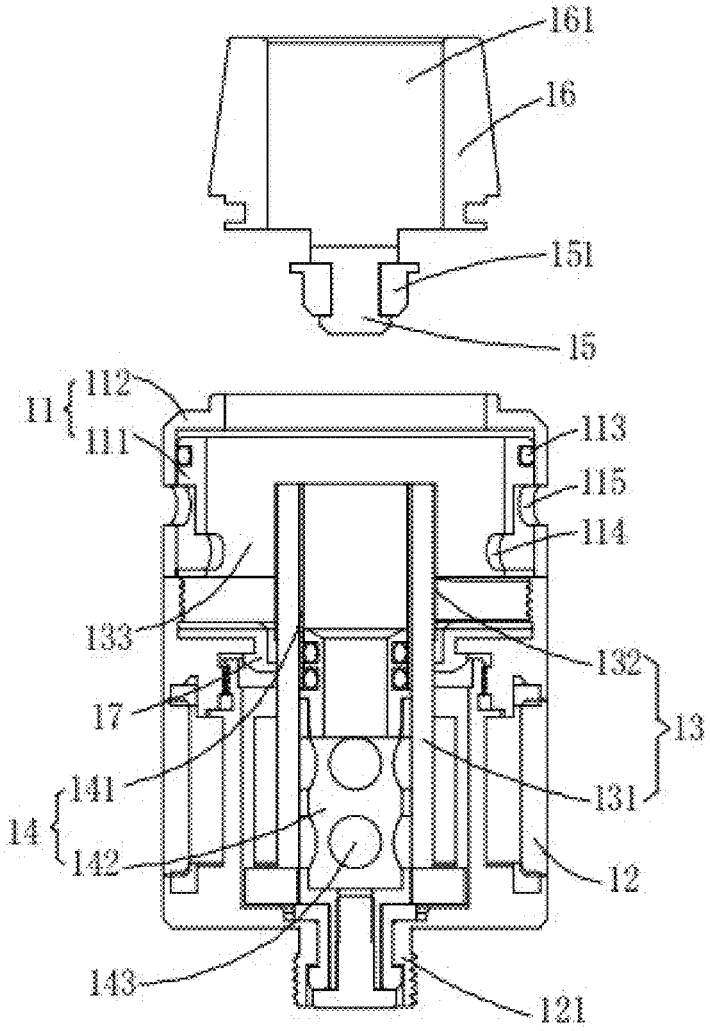
FIG. 1 is an exploded cross-sectional view of an atomizer of an electronic cigarette according to an embodiment of the present disclosure.
Figure 2:
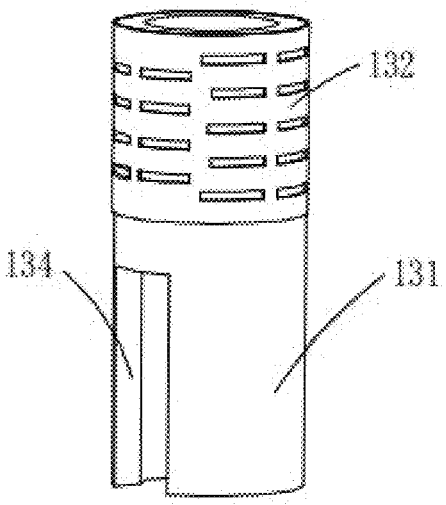
FIG. 2 is a front perspective view of an atomizing assembly in FIG. 1.

Referring to FIG. 1 and FIG. 2, the present disclosure generally relates to an atomizer of an electronic cigarette including an sleeve 11, a liquid storage sleeve 12 and an atomizing assembly 13.

The sleeve 11 includes an inner sleeve 111 and an outer sleeve 112 inserted into each other. In some variations, a side wall of the inner sleeve 111 close to the outer sleeve 112 has an elastic apron. In a process of inserting the inner sleeve 111 into the outer sleeve 112, the outer sleeve 112 squeezes the elastic apron to allow the outer sleeve 112 sleeved on outside of the inner sleeve 111 while sealed therebetween.

Further, side walls of the inner sleeve 111 and the outer sleeve 112 respectively have a first air inlet 114 and a second air inlet 115, the first air inlet 114 is communicated with the second air inlet 115 to allow exterior air to flow into inner sleeve 111 through the second air inlet 115 and the first air inlet 114.

The liquid storage sleeve 12 is disposed at an end of the sleeve 11 along an axial direction of the sleeve 11 for storing the tobacco liquid. Optionally, the liquid storage sleeve 12 and the sleeve 11 may be detachably connected, such as by a thread connection.

In the embodiment, the first air inlet 114 is closer to the liquid storage sleeve 11 compared to the second air inlet 115 along an axial of the sleeve 11. As shown in FIG. 1, the first air inlet 114 is disposed under the second air inlet 115 to get closer to the liquid storage sleeve 12 that is under the first air inlet 114.

Further, a bottom of the liquid storage sleeve 12 away from the sleeve 11 has a power supply connecter 121 configured for connecting a power supply that supplies power to the aforementioned atomizer.

In some variations, the power supply connecter 121 is detachably connected with the power supply, such as by a thread connection.

Referring to FIG. 1 and FIG. 2, the atomizing assembly 13 includes a liquid conducting body 131 and a heating element 132, the liquid conducting body 131 is disposed in the sleeve 11 along an axial direction of the sleeve 11, extending from the sleeve 11 into the liquid storage sleeve 12; the heating element 132 is sleeved on outside of the liquid conducting body 131 and configured for heating the tobacco liquid absorbed by the liquid conducting body 131, to generate an aerosol in an atomizing space 133 between the sleeve 11 and the heating element 132.

In some variations, the liquid conducting body 131 is a liquid conducting cotton or fiber, the heating element 131 is a heating wire or a heating net, to surround or contact the liquid conducting body 131 in the sleeve 11.

In some variations, the liquid conducting body 131 is a barrel-shaped structure, provided inside with an liquid filling tube 14; the liquid filling tube 14 extends from the sleeve 11 into the liquid storage sleeve 12 and is configured for conveying the tobacco liquid that is injected into the liquid filling tube 14 through an distal end of the sleeve 11 away from the liquid storage sleeve 12, to the liquid storage sleeve 12.

Figure 3:
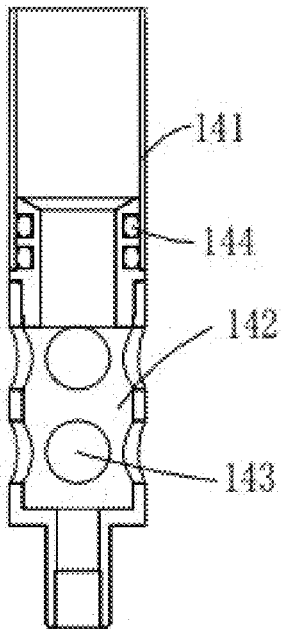
FIG. 3 is a cross-sectional view of an liquid filling tube in FIG. 1.

Referring to FIG. 3, the liquid filling tube 14 includes a first liquid filling tube 141 and a second liquid filling tube 142 detachably connected with each other, an end of the first liquid filling tube 141 is disposed in the sleeve 11, the other end of the first liquid filling tube 141 is detachably connected with the second liquid filling tube 142. At least partial second liquid filling tube 142 is disposed in the liquid storage sleeve 12 and the second liquid filling tube 142 has an liquid inlet 143 communicated with an opening 134 of the liquid conducting body 134, allowing the liquid inlet 143 in communication with the liquid storage sleeve 12. As a result, when adding tobacco liquid through an end of the first liquid filling tube 141 disposed in the sleeve 11, the tobacco liquid flows into the second liquid filling tube 142, passing through the liquid inlet 143 of the second liquid filling tube 142 and the opening 134 of the liquid conducting body 131, into the liquid storage sleeve 12.

In some variations, an end of the second liquid filling tube 142 is detachably connected with the other end of the first liquid filling tube 141, the other end of the second liquid filling tube 142 is fixed with the bottom of the liquid storage sleeve 12, which makes the liquid filling tube 14 be fixed with the corresponding liquid storage sleeve 12, further supports the liquid conducting body 131 disposed outside the liquid filling tube 14.

In some embodiments, the first liquid filling tube 141 and the second liquid filling tube 142 may be detachably inserted with each other. More specifically, outside of the end of the second liquid filling tube 142 has an elastic apron 144, one end of the second liquid filling tube 142 will be inserted into one end of the first liquid filling tube 141 during inserted, the other end of the first liquid filling tube 141 squeezes the elastic apron 144 to fix the first liquid filling tube 141 with the second liquid filling tube 142 after inserted. Using external forces the first liquid filling tube 141 will be separated from the elastic apron 144 of the second liquid filling tube 142 during detached.

Figure 4:
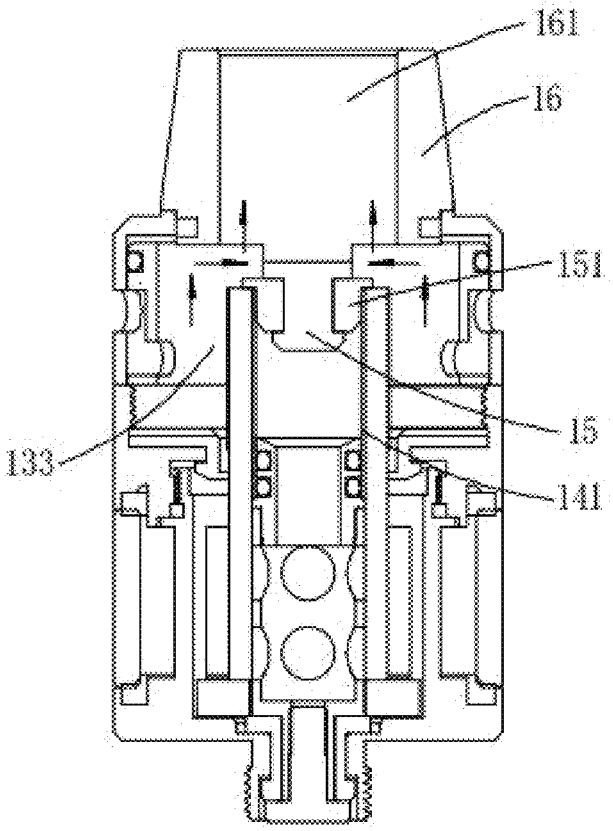
FIG. 4 is an assembled cross-sectional view of the atomizer in FIG. 1.

Referring to FIG. 1 and FIG. 4, the distal end of the liquid filling tube 14 away from the liquid storage sleeve 12 has a cover component 15, detachably connected with the liquid filling tube 14. During injecting the tobacco liquid, the liquid filling tube 14 is detached from the cover component 15, as shown in FIG. 1, and after injecting the injecting cover 14 is blocked by the cover component 15, as shown in FIG. 4.

More specifically, the first liquid filling tube 141 is inserted with the cover component 15, in some variations, outside of the cover component 15 has an elastic apron 151, as shown in FIG. 4, when the cover component 15 is inserted into the first liquid filling tube 141, the first liquid filling tube 131 squeezes the elastic apron 151 to make the cover component 15 block the liquid filling tube 14. When it needs to inject tobacco liquid, as shown in FIG. 1, using external forces the elastic apron 151 is detached from the first liquid filling tube 131, to draw the cover component 15 out of the first liquid filling tube 131.

Further, in the embodiment, the electronic cigarette includes a mouth piece 16, disposed at the other end of the sleeve 11 along the axial direction thereof; the mouth piece 16 and the cover component 15 are integrally set together, as shown in FIG. 1, during injecting the tobacco liquid, the cover component 15 and the mouth piece 16 are simultaneously detached from the first liquid filling tube 141.

The mouth piece 16 is provided with an aerosol outlet pipe 161, the aerosol in the atomizing space 133 between the sleeve 11 and the heating element 132, flows into the aerosol outlet pipe 161 through an L-shaped passage.

With reference to FIG. 4, the aerosol outlet pipe 161 is communicated with the atomizing space 133 between the sleeve 11 and the heating element 132, to make the first air inlet 114 and the second air inlet 115 of the sleeve 11, the atomizing space and the aerosol outlet pipe 161 encompass a airflow passage, furthermore, a radial size of the aerosol outlet pipe 161 is less than the radial size of the liquid conducting body 131. When the aerosol generated in the atomizing space 133, alongside the airflow in the airflow passage, flows into the aerosol outlet pipe 161 located over the atomizing space 133, the aerosol alongside the airflow further flows into the aerosol outlet pipe 161 according to the direction that arrows show in FIG. 6.

Referring to FIG. 1, the atomizer includes a separator 17 sleeved on outside of the liquid conducting body 131 to avoid the tobacco liquid in the liquid storage sleeve 12 flowing from outside of the liquid conducting body 131 into the atomizing space 133.

Further, the separator 17 is an elastic ring, outside edge of the elastic ring is fixed by the sleeve 11 and the liquid storage sleeve 12, the inside edge of the elastic ring abuts against the liquid conducting body 131.

The present disclosure also relates to an electronic cigarette including the aforementioned atomizer, and a power supply for supplying power to the atomizer.

Compared to the prior art known to the inventors, the present disclosure utilizes a liquid storage sleeve disposed at an end of the sleeve along an axial direction of the sleeve, the liquid conducting body is disposed in the sleeve along an axial direction of the sleeve, extending from the sleeve into the liquid storage sleeve; the heating element is sleeved on outside of the liquid conducting body and configured for heating the tobacco liquid absorbed by the liquid conducting body, to generate an aerosol in an atomizing space between the sleeve and the heating element. Compared to the prior art of the heating element arranged inside the liquid conducting body to generate an aerosol, the atomizing space is bigger, since contact surface between the heating element and the liquid conducting body, the atomizing effect of the heating element with the tobacco liquid in the liquid conducting body is more deep, therefore, it is difficult for the heating element to generate incomplete tobacco liquid membrane, thus the user experience and safety have been improved.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a sleeve;

a liquid storage sleeve disposed at an end of the sleeve along an axial direction of the sleeve; and an atomizing assembly, wherein the atomizing assembly comprises a liquid conducting body and a heating element; the liquid conducting body is disposed in the sleeve along an axial direction of the sleeve, extending from the sleeve into the liquid storage sleeve; the heating element is sleeved on outside of the liquid conducting body and configured for heating tobacco liquid absorbed by the liquid conducting body from the liquid storage sleeve, to generate an aerosol in an atomizing space between the sleeve and the heating element.

2. The atomizer according to claim 1, wherein the liquid conducting body is a barrel-shaped structure, provided inside with a liquid filling tube; the liquid filling tube extends from the sleeve into the liquid storage sleeve and is configured for conveying the tobacco liquid that is injected into the liquid filling tube through a distal end of the sleeve away from the liquid storage sleeve, to the liquid storage sleeve.

3. The atomizer according to claim 2, wherein an distal end of the liquid filling tube away from the liquid storage sleeve comprises a cover component, the cover component is detachably connected with the liquid filling tube; when injecting the tobacco liquid into the liquid filling tube, the cover component is detached from the liquid filling tube; and the cover component blocks the liquid filling tube after injecting tobacco liquid.

4. The atomizer according to claim 3, wherein the liquid filling tube comprises a first liquid filling tube and a second liquid filling tube detachably connected with each other, the first liquid filling tube is inserted with the cover component, at least partial second liquid filling tube is disposed in the liquid storage sleeve, a side wall of the second liquid filling tube has an liquid inlet communicated with the liquid storage sleeve.

5. The atomizer according to claim 4, wherein the atomizer comprises a mouth piece disposed at the other end of the sleeve along an axial direction of the sleeve; the mouth piece has an aerosol outlet pipe, the aerosol in the atomizing space flows into the aerosol outlet pipe through an L-shaped passage.

6. The atomizer according to claim 5, wherein a radial size of the aerosol outlet pipe is less than that of the liquid conducting body.

7. The atomizer according to claim 6, wherein the sleeve comprises an inner sleeve and an outer sleeve inserted into each other; side walls of the inner sleeve and the outer sleeve respectively have a first air inlet and a second air inlet, the first air inlet is closer to the liquid storage sleeve compared to the second air inlet along an axial of the sleeve.

8. The atomizer according to claim 1, wherein the atomizer further comprises a separator sleeved on outside of the liquid conducting body to avoid the tobacco liquid in the liquid storage sleeve to flow from outside of the liquid conducting body into the atomizing space.

9. The atomizer according to claim 8, wherein the separator is an elastic ring, outside edge of the elastic ring is fixed by the sleeve and the liquid storage sleeve, the inside edge of the elastic ring abuts against the liquid conducting body.

10. An electronic cigarette, comprising:

the atomizer, comprising:

a sleeve;

a liquid storage sleeve disposed at an end of the sleeve along an axial direction of the sleeve; and an atomizing assembly, wherein the atomizing assembly comprises a liquid conducting body and a heating element; the liquid conducting body is disposed in the sleeve along an axial direction of the sleeve, extending from the sleeve into the liquid storage sleeve; the heating element is sleeved on outside of the liquid conducting body and configured for heating tobacco liquid absorbed by the liquid conducting body from the liquid storage sleeve, to generate an aerosol in an atomizing space between the sleeve and the heating element.

11. The electronic cigarette according to claim 10, wherein the liquid conducting body is a barrel-shaped structure, provided inside with a liquid filling tube; the liquid filling tube extends from the sleeve into the liquid storage sleeve and is configured for conveying the tobacco liquid that is injected into the liquid filling tube through a distal end of the sleeve away from the liquid storage sleeve, to the liquid storage sleeve.

12. The electronic cigarette according to claim 11, wherein an distal end of the liquid filling tube away from the liquid storage sleeve comprises a cover component, the cover component is detachably connected with the liquid filling tube; when injecting the tobacco liquid into the liquid filling tube, the cover component is detached from the liquid filling tube; and the cover component blocks the liquid filling tube after injecting tobacco liquid.

13. The electronic cigarette according to claim 12, wherein the liquid filling tube comprises a first liquid filling tube and a second liquid filling tube detachably connected with each other, the first liquid filling tube is inserted with the cover component, at least partial second liquid filling tube is disposed in the liquid storage sleeve, a side wall of the second liquid filling tube has an liquid inlet communicated with the liquid storage sleeve.

14. The electronic cigarette according to claim 13, wherein the atomizer comprises a mouth piece disposed at the other end of the sleeve along an axial direction of the sleeve; the mouth piece has an aerosol outlet pipe, the aerosol in the atomizing space flows into the aerosol outlet pipe through an L-shaped passage.

15. The electronic cigarette according to claim 14, wherein a radial size of the aerosol outlet pipe is less than that of the liquid conducting body.

16. The electronic cigarette according to claim 15, wherein the sleeve comprises an inner sleeve and an outer sleeve inserted into each other; side walls of the inner sleeve and the outer sleeve respectively have a first air inlet and a second air inlet, the first air inlet is closer to the liquid storage sleeve compared to the second air inlet along an axial of the sleeve.

17. The electronic cigarette according to claim 10, wherein the atomizer further comprises a separator sleeved on outside of the liquid conducting body to avoid the tobacco liquid in the liquid storage sleeve to flow from outside of the liquid conducting body into the atomizing space.

18. The electronic cigarette according to claim 17, wherein the separator is an elastic ring, outside edge of the elastic ring is fixed by the sleeve and the liquid storage sleeve, the inside edge of the elastic ring abuts against the liquid conducting body.

* * * * *